US009687409B2

(12) United States Patent
Teng et al.

(10) Patent No.: US 9,687,409 B2
(45) Date of Patent: Jun. 27, 2017

(54) WALKING ASSIST DEVICE

(71) Applicant: Industrial Technology Research Institute, Hsinchu (TW)

(72) Inventors: Ming-Chang Teng, Hsinchu (TW); Yi-Jeng Tsai, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 295 days.

(21) Appl. No.: 14/519,145

(22) Filed: Oct. 21, 2014

(65) Prior Publication Data

US 2015/0272810 A1 Oct. 1, 2015

(30) Foreign Application Priority Data

Mar. 27, 2014 (TW) ..... 103111511 A

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0244* (2013.01); *A61H 2003/007* (2013.01); *A61H 2201/0192* (2013.01); *A61H 2201/1207* (2013.01); *A61H 2201/163* (2013.01); *A61H 2201/165* (2013.01); *A61H 2201/1642* (2013.01)

(58) Field of Classification Search
CPC ..... A61H 3/00; A61H 1/0244; A61H 1/024; A61H 2201/1642; A61H 2201/0192; A61H 2003/007; A61H 2201/165; A61H 2201/163; A61H 2201/1207
See application file for complete search history.

(56) References Cited

U.S. PATENT DOCUMENTS 7,153,242 B2 12/2006 Goffer
7,628,766 B1 12/2009 Kazerooni et al.
(Continued)

FOREIGN PATENT DOCUMENTS

CN 1872016 12/2006
CN 101111211 1/2008
(Continued)

OTHER PUBLICATIONS

Gomes et al., "Gait-pattern adaptation algorithms based on neural network for lower limbs active orthoses," IEEE/RSJ International Conference on Intelligent Robots and Systems, 2009, pp. 4475-4480.

(Continued)

*Primary Examiner* — Quang D Thanh
(74) *Attorney, Agent, or Firm* — Jianq Chyun IP Office

(57) ABSTRACT

A walking assist device including a waist assembly and at least one leg assembly connected to the waist assembly is provided. The leg assembly includes a thigh stand, a shank stand, a sole, a hip joint, a knee joint and an ankle joint. The hip joint is pivoted to the thigh. The knee joint is pivoted to the thigh stand and connected to the shank stand. The ankle joint includes at least a flexible plate and an elastic member. The flexible plate includes a first end and a second end opposite to each other. The first end is pivoted to the shank stand directly or indirectly, the second end is connected to the sole, and the elastic member presses the first end of the flexible plate.

10 Claims, 10 Drawing Sheets

(56) References Cited

U.S. PATENT DOCUMENTS

| | | | | |
|---|---|---|---|---|
| 8,070,700 | B2 | 12/2011 | Kazerooni et al. | |
| 8,096,965 | B2 | 1/2012 | Goffer et al. | |
| 8,348,875 | B2 | 1/2013 | Goffer et al. | |
| 2007/0056592 | A1 | 3/2007 | Angold et al. | |
| 2010/0094188 | A1* | 4/2010 | Goffer | B25J 9/0006 602/23 |
| 2010/0204627 | A1 | 8/2010 | Kazerooni et al. | |
| 2013/0197408 | A1 | 8/2013 | Goldfarb et al. | |
| 2015/0025423 | A1* | 1/2015 | Caires | A61H 1/024 601/35 |
| 2015/0196403 | A1* | 7/2015 | Kim | A61F 2/70 623/24 |

FOREIGN PATENT DOCUMENTS

| | | |
|---|---|---|
| CN | 103330635 | 10/2013 |
| EP | 1728492 | 12/2006 |
| JP | H11290360 | 10/1999 |
| JP | 2002250330 | 9/2002 |
| JP | 2004174007 | 6/2004 |
| JP | 2006204426 | 8/2006 |
| JP | 4112543 | 7/2008 |
| JP | 4178187 | 11/2008 |
| JP | 2009207840 | 9/2009 |
| JP | 2009291395 | 12/2009 |
| JP | 2010000204 | 1/2010 |
| JP | 2010035899 | 2/2010 |
| JP | 2010110381 | 5/2010 |
| JP | 2013022091 | 2/2013 |
| JP | 2013116206 | 6/2013 |
| TW | 201124127 | 7/2011 |
| TW | 201141457 | 12/2011 |
| TW | 201436780 | 10/2014 |
| WO | 2010079862 | 7/2010 |

OTHER PUBLICATIONS

Talaty et al., "Differentiating ability in users of the ReWalk powered exoskeleton: An analysis of walking kinematics," IEEE International Conference on Rehabilitation Robotics, 2013, pp. 1-5.

Esquenazi et al., "The ReWalk powered exoskeleton to restore ambulatory function to individuals with thoracic-level motor-complete spinal cord injury," American Journal of Physical Medicine & Rehabilitation, 2012, pp. 911-921.

Zeilig et al., "Safety and tolerance of the ReWalk™ exoskeleton suit for ambulation by people with complete spinal cord injury: a pilot study," The Journal of Spinal Cord Medicine, 2012, pp. 96-101.

Farris et al., "Preliminary Evaluation of a Powered Lower Limb Orthosis to Aid Walking in Paraplegic Individuals," IEEE Transactions on Neural Systems and Rehabilitation Engineering, Dec. 2011, pp. 652-659.

Quintero et al., "Control and implementation of a powered lower limb orthosis to aid walking in paraplegic individuals," IEEE International Conference on Rehabilitation Robotics, Jun. 29-Jul. 1, 2011, pp. 1-6.

"Office Action of Europe Counterpart Application", issued on Aug. 27, 2015, p. 1-p. 7.

* cited by examiner

WALKING ASSIST DEVICE

CROSS-REFERENCE TO RELATED APPLICATION

This application claims the priority benefit of Taiwan application serial no. 103111511, filed on Mar. 27, 2014. The entirety of the above-mentioned patent application is hereby incorporated by reference herein and made a part of this specification.

BACKGROUND OF THE DISCLOSURE

1. Field of the Disclosure

The disclosure generally relates to a walking assist device, and more particularly, to a walking assist device having favorable stability.

2. Description of Related Art

According to medical statistics in Europe and America, spinal cord injury (SCI) patients are close to one-thousandth of the population, people worldwide about 7 million, increasing in the number of 350 thousand people each year. In addition, according to statistics of Taiwan Spinal Cord Injury Potential Development Center, the number of SCI patients in Taiwan is close to 23 thousand, increasing in the rate of 1200 people each year. According to the description above, spinal cord injury patients are no longer minority, and in order to assist the patients to return to normal life, each country has invested in the development related to walking assist devices.

In the case of the current walking assist devices, after wearing the walking assist device and collocated with assisting implements like crutches and so on, the user may be able to do functions such as getting up, sitting down, walking, going uphill and downhill, going upstairs and down stairs, and the like to complete daily life. However, in order to reduce the possibility that the user topples and falls out of balance during movement, the walking assist device is still required to be developed towards high stability.

SUMMARY OF THE DISCLOSURE

The disclosure provides a walking assist device having favorable stability.

A walking assist device of the disclosure includes a waist assembly and at least one leg assembly. Each leg assembly is connected to the waist assembly. The leg assembly includes a thigh stand, a shank stand, a sole, a hip joint, a knee joint and an ankle joint. The hip joint is pivoted to the thigh stand. The knee joint is pivoted to the thigh stand and connected to the shank stand. The ankle joint includes a flexible plate and an elastic member. The flexible plate includes a first end and a second end opposite to the first end, the first end is directly or indirectly pivoted to the shank stand, the second end is connected to the sole, and the elastic member presses the first end of the flexible plate.

In light of the above, the ankle joint of the walking assist device of the disclosure is directly or indirectly pivoted to the shank stand via the first end of the flexible plate, the second end of the flexible plate is connected to the sole, the flexible plate may generate left and right bending deformation due to the shift of center of mass when the user walks, such that when the user walks the soles may completely contact with the floor and when the user's body inclines the soles may not be apart from the floor, and stability and safety during walking may be effectively enhanced. In addition, the elastic member on the ankle joint presses the first end of the flexible plate, so as to provide a larger friction force between the shank stand and the ankle joint, when the user raises his leg, dangerous situation that the sole hangs down by gravity to cause the front part of foot contact with the floor may be prevented, and stability during walking may further be increased.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
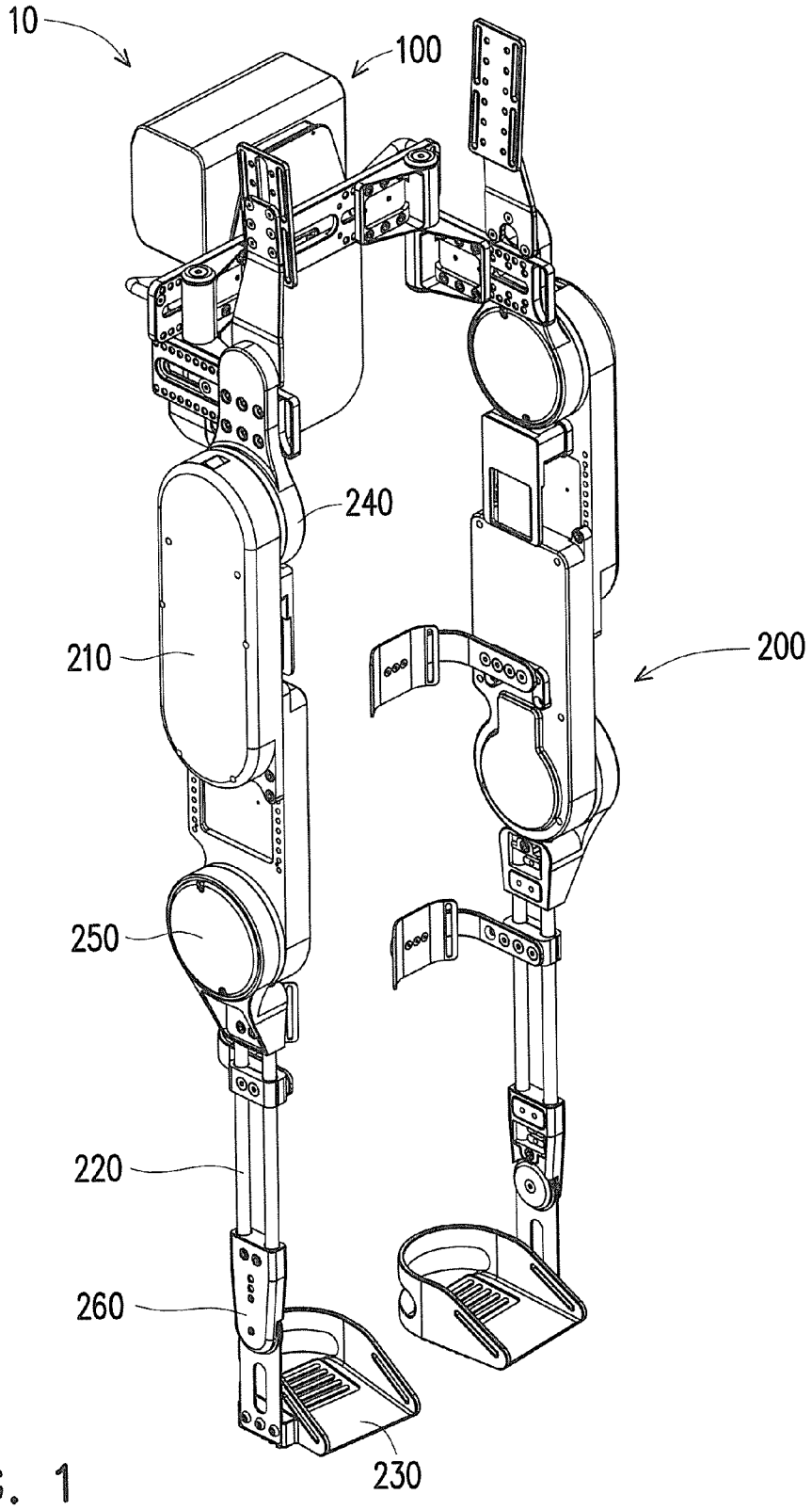
FIG. 1 is a schematic perspective view of a walking assist device according to one exemplary embodiment of the disclosure.
Figure 2:
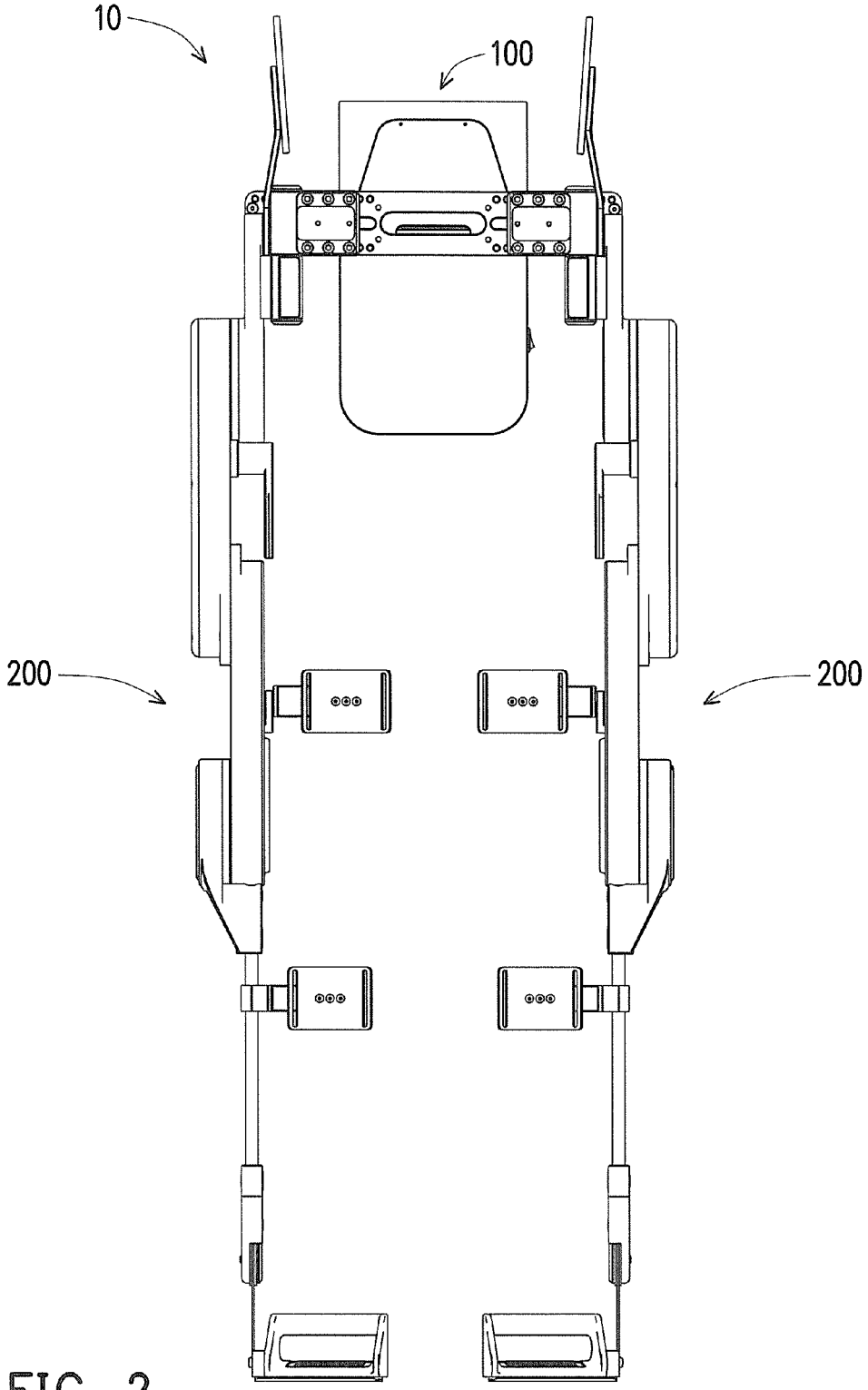
FIG. 2 is a schematic front view of the walking assist device of FIG. 1.
Figure 3:
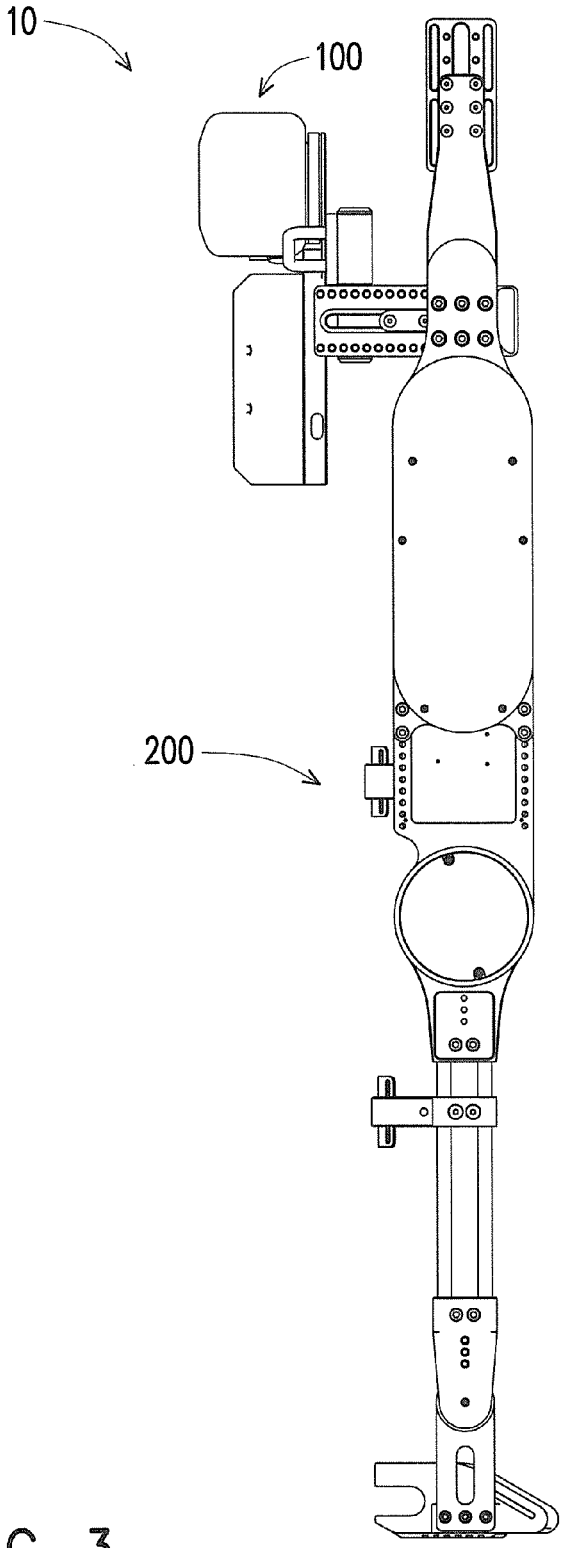
FIG. 3 is a schematic side view of the walking assist device of FIG. 1.
Figure 4:
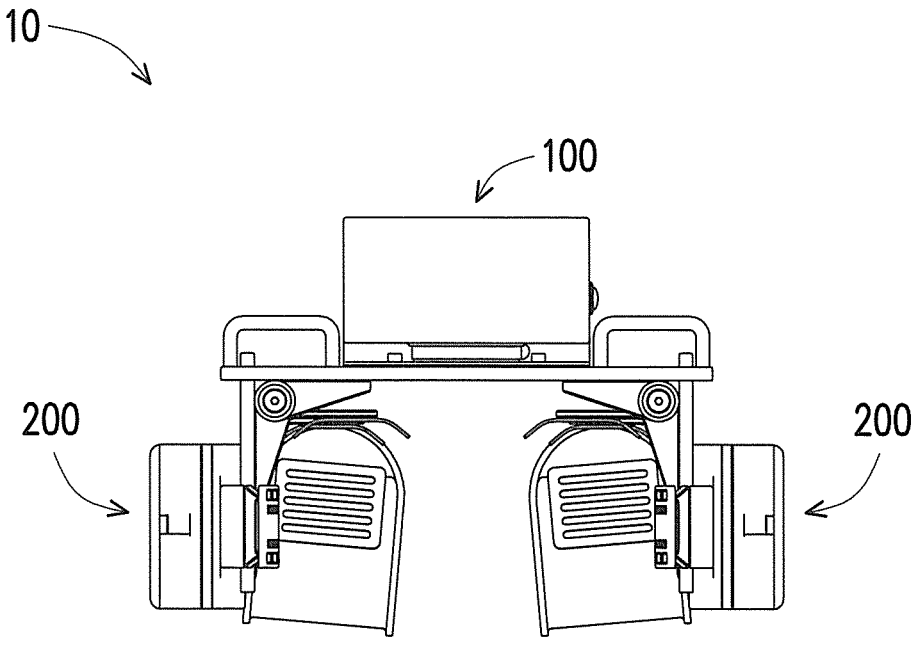
FIG. 4 is a schematic top view of the walking assist device of FIG. 1.

FIG. 1 is a schematic perspective view of a walking assist device according to one exemplary embodiment of the disclosure. FIG. 2 is a schematic front view of the walking assist device of FIG. 1. FIG. 3 is a schematic side view of the walking assist device of FIG. 1. FIG. 4 is a schematic top view of the walking assist device of FIG. 1. Referring to FIG. 1 to FIG. 4, the walking assist device 10 includes a waist assembly 100 and at least one leg assembly 200. The waist assembly 100 is used for supporting a user's waist, in the embodiment, the quantity of the leg assembly 200 is two, and each leg assembly 200 is connected to the waist assembly 100 and used for installing to a user's leg portion. In more detailed, the two leg assemblies 200 may stay close to the outer sides of the user's left and right thighs. However, in other embodiments, the quantity of the leg assembly 200 may also be one, so that users who lose function of one leg may use it.

Each leg assembly 200 includes a thigh stand 210, a shank stand 220, a sole 230, a hip joint 240, a knee joint 250 and an ankle joint 260. The hip joint 240 is pivoted to the thigh stand 210. The knee joint 250 is pivoted to the thigh stand 210 and connected to the shank stand 220. The ankle joint 260 is pivoted to the shank stand 220 and connected to the sole 230. In the leg assembly 200 of the embodiment, the thigh stand 210, the shank stand 220 and the sole 230 may relatively rotate therebetween via the hip joint 240, the knee joint 250 and the ankle joint 260, and the length of each stand may also be adjusted to match the user.

Figure 5:
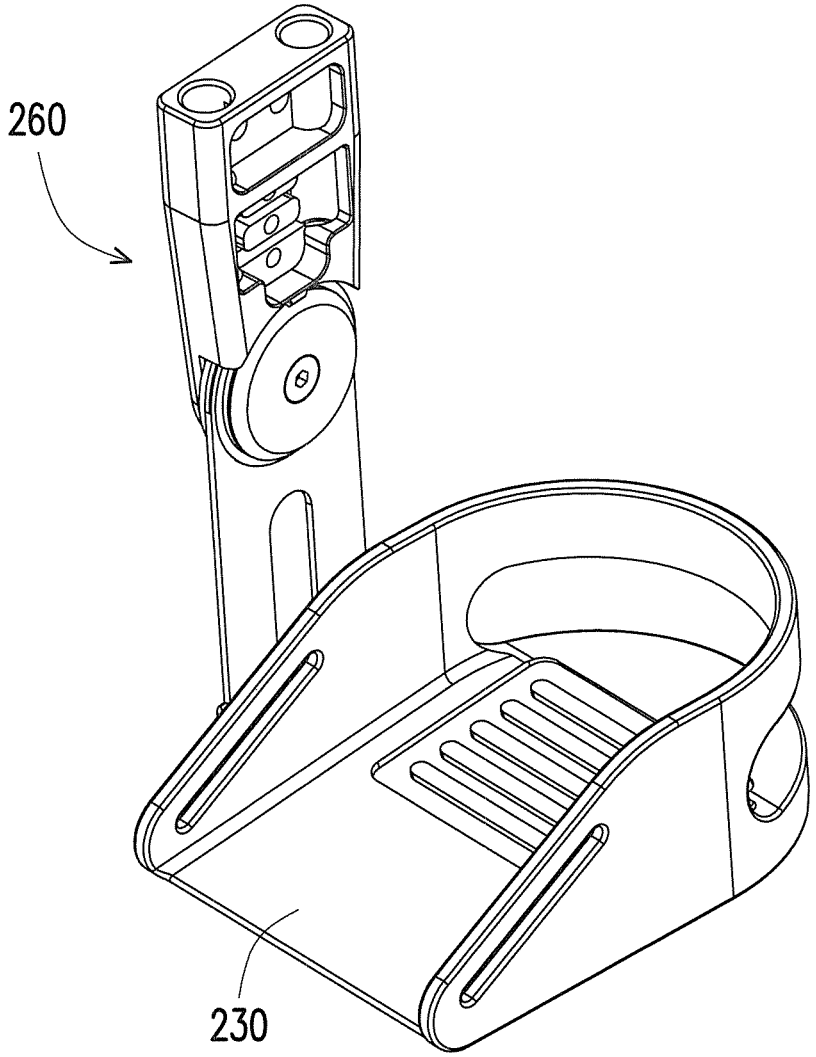
FIG. 5 is a schematic perspective view of the ankle joint and the sole of the walking assist device of FIG. 1.
Figure 6:
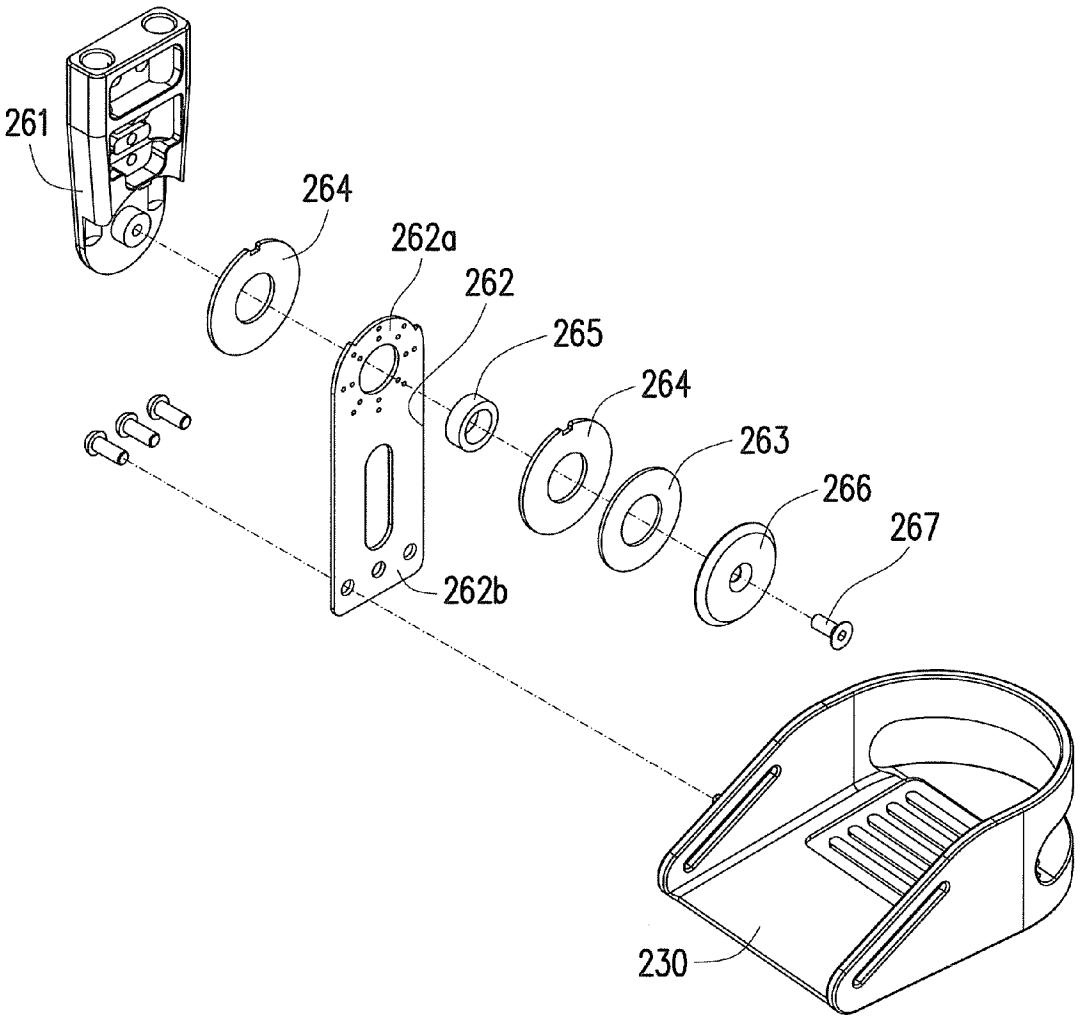
FIG. 6 is a schematic exploded view of the ankle joint and the sole of FIG. 5.

FIG. 5 is a schematic perspective view of the ankle joint and the sole of the walking assist device of FIG. 1. FIG. 6 is a schematic exploded view of the ankle joint and the sole of FIG. 5. Referring to FIG. 5 and FIG. 6, in the embodiment, the ankle joint 260 includes a fixing plate 261 and a flexible plate 262. The fixing plate 261 is connected to the shank stand 220. The flexible plate 262 includes a first end 262*a* and a second end 262*b* opposite to each other, the first end 262*a* is pivoted to the fixing plate 261, and the second end is connected to the sole 230. In the embodiment, the flexible plate 262 is a metal plate with a slight flexibility or an elastic plastic plate, but the material of the flexible plate 262 is not limited thereto, as long as the flexible plate 262 is a material which may slightly be flexible in the normal vector direction and has a certain support function.

The flexible plate 261 may generate left and right bending deformation due to the shift of center of mass when the user walks, such that when the user walks the angle of inner and outer sides of the sole 230 may be fine-tuned, so that the sole 230 may completely contact with the floor, and the supination or pronation may be prevented. As such, even though when the user's body inclines during walking, the soles 230 may not be apart from the floor to cause the user to lose the center of mass, and stability and safety during walking may be effectively enhanced. In other embodiments, the ankle joint 260 may also be provided without the fixing plate 261, instead the flexible plate 262 is directly pivoted to the shank stand 220, and the type of the ankle joint 260 is not limited thereto.

In addition, the sole 230 and the shank stand 220 are pivoted by the ankle joint 260, if the friction force at the pivoting place is smaller, the sole 230 and the shank stand 220 may relatively be rotated quite easily, and when the user raises the foot during walking, the front end of the sole 230 may naturally hang down by gravity. In more detailed, the farther end of the sole 230 from the ankle joint 260 may be down and contact with the floor, and dangerous situation that the user's tiptoe rubs against the floor and trips over may occur. In order to reduce the possibility of the abovementioned situation, in the embodiment, the ankle joint 260 further includes an elastic member 263 disposed at a side of the first end 262*a* of the flexible plate 262, so as to press the first end 262*a* of the flexible plate 262. Then the elastic member 263 may provide a larger friction force to the fixing plate 261 and the flexible plate 262, such that the angle of the relative rotation between the shank stand 220 and the sole 230 may be limited. As such, when the user raises the foot, dangerous situation that the sole 230 hangs down by gravity to cause the front part of foot contact with the floor may be prevented, and stability during walking may further be increased. In the embodiment, the elastic member 263 is a leaf spring, but in other embodiments, the elastic member 263 may also be a spring or a compressible element formed by elastic material.

In addition, as shown in FIG. 6, the ankle joint 260 further includes two spacers 264, an adjusting ring 265, an outer casing 266 and a fastening member 267, wherein the two spacers 264 sandwich the first end 262*a* of the flexible plate 262, the spacers 264 are manufactured by wear-resisting material, e.g., polymer material or the like, in order to enhance the wear-resistance between the flexible plate 262 and the fixing plate 261. The adjusting ring 265 can enhance the effect of the elastic member 263, so that the first end 262*a* of the flexible plate 262 maintains a constant damping effect. In the embodiment, the two spacers 264, the first end 262*a* of the flexible plate 262, the adjusting ring 265, the elastic member 263, the outer casing 266 are coaxial, the two spacers 264, the first end 262*a* of the flexible plate 262, the adjusting ring 265 and the elastic member 263 are enclosed by the outer casing 266 and fixed to the fixing plate 261 by the fastening member 267. However, each of the parts except the flexible plate 262, may be appropriately increased or reduced to meet the processing requirement, and it is not limited by the embodiment.

In the embodiment, the sole 230 is a half type sole, in other words, the sole 230 merely encloses the user' sole or the rear half portion of the shoe's sole. As such, when the user wears the walking assist device 10 and steps forward, the situation that the front end of the shoe's sole contacts with the floor may be reduced. Certainly, in other embodiments, the sole 230 may also be a sole which can enclose the whole sole of the foot or the whole sole of the shoe, and the type of the sole 230 is not limited thereto.

Figure 7:
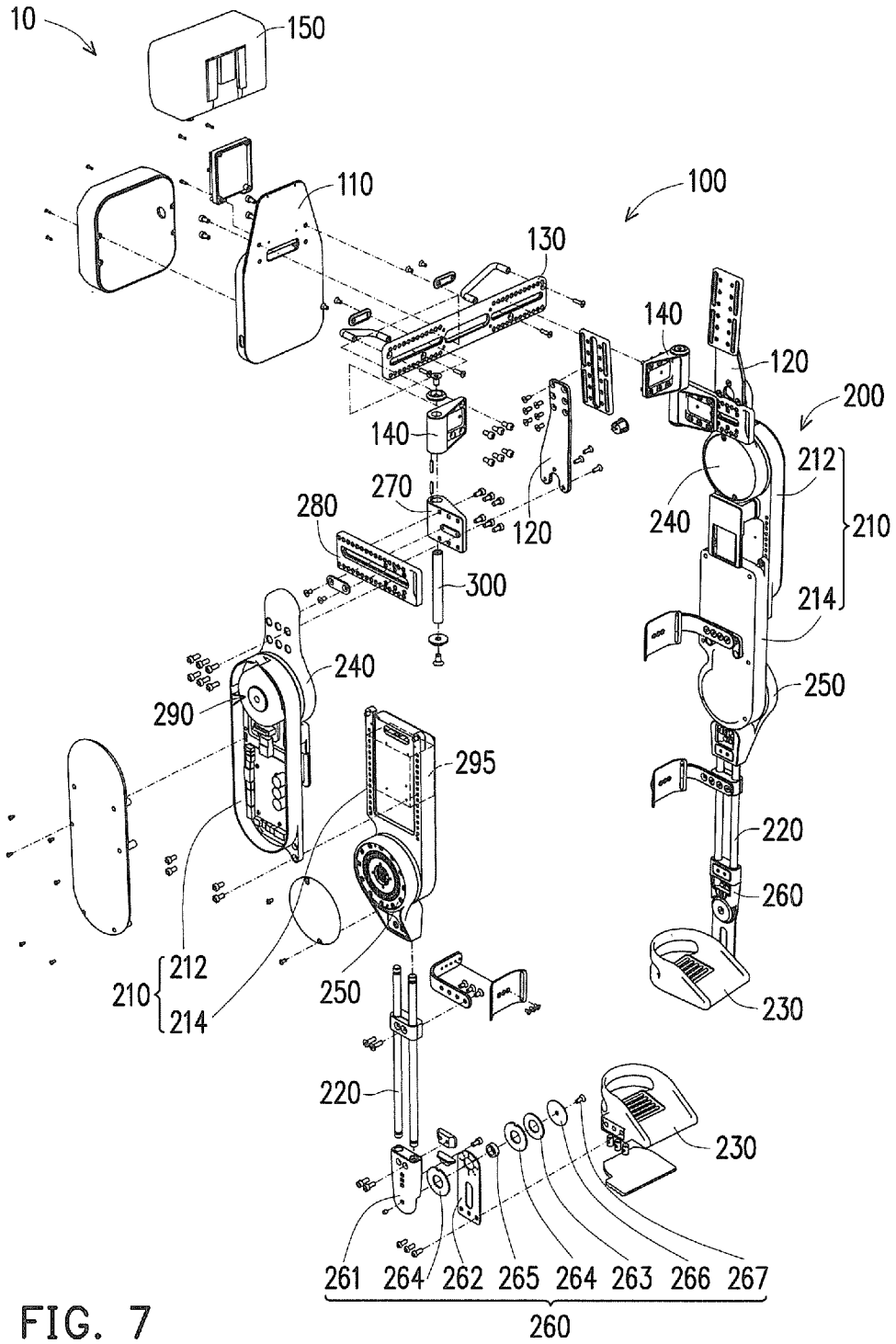
FIG. 7 is a schematic exploded view of the waist assembly and one of the leg assemblies of the walking assist device of FIG. 1.

FIG. 7 is a schematic exploded view of the waist assembly and one of the leg assemblies of the walking assist device of FIG. 1. Referring to FIG. 1 and FIG. 7 together, in the embodiment, the waist assembly 100 includes a hip reaction plate 110, two chest side plates 120, a left-right adjusting member 130 and two first movable members 140. The hip reaction plate 110 is used for propping against the user's hips, so as to provide a reaction force during walking.

In the embodiment, the two chest side plates 120 are respectively connected to the two leg assemblies 200 and extend in a direction away from the thigh stand 210 (i.e., upward), so as to restrain the user's chest, such that the user may raise the leg assembly 200 to step forward by using weight shift of the upper body.

In the embodiment, there are a plurality of threaded holes on the left-right adjusting member 130, the two first movable members 140 are adjustably fixed on the left-right adjusting member 130 by fastening, so that the user may adjust the distance between the two first movable members 140 according to the body shape, so as to adjust the width of the waist.

Each leg assembly 200 further includes a second movable member 270 and two front-rear adjusting members 280, the walking assist device 10 further includes two pivoting shafts 300, and each pivoting shaft 300 pivots one of the first movable members 140 and one of the second movable member 270, so that the leg assembly 200 is adjustably connected to the left-right adjusting member 130 along a left-right direction axis.

There are also a plurality of threaded holes on the front-rear adjusting member 280, the two second movable members 270 are adjustably fixed on the front-rear adjusting member 280 by fastening in a front-rear direction axis, so that the user may adjust the thickness of the hips according to the body shape.

The thigh stand 210 is fixed on the front-rear adjusting member 280. In the embodiment, the thigh stand 210 includes an upper stand 212 and a lower stand 214, and the lower stand 214 is adjustably fixed to the upper stand 212. In more detailed, before the upper stand 212 and the lower stand 214 are fixed, the upper stand may be slidably disposed at the lower stand 214 along the vertical direction, so that the relative position between the upper stand 212 and the lower stand 214 is adjusted according to the user's thigh length, so as to change the distance between the hip joint 240 and the knee joint 250.

In addition, a portion of the shank stand 220 is adjustably inserted into the knee joint 250 and has a plurality of threaded holes for fastening and fixing, namely, the distance between the knee joint 250 and the ankle joint 260 may be adjusted according to the user's shank length. Therefore, the relative positions between the components of the walking assist device 10 of the embodiment may be adjusted according to the user's waist width, hip width, thigh length and shank length, so as to meet demands of more users.

Certainly, in other embodiments, the walking assist device 10 may also be a customized product, a device which is directly designed and manufactured in accordance with the users body shape to fit with hip width, waist width, thigh length and shank length, and the left-right adjusting member 130, the front-rear adjusting member 280, the upper stand 212 and the lower stand 214 of which the relative position may be adjusted, and the shank stand 220 of which the position may be adjusted are not necessary.

In addition, in the embodiment, the walking assist device 10 may be provided to groups who are physical disabilities caused by symptoms such as incomplete spinal cord injury below thoracic spine, complete spinal cord injury at lower levels, complete spinal cord injury at median levels, or the like, the common characteristic of that groups is lower limbs completely paralyzed or unable to support, but having strong upper body and ability to use hip guidance orthosis (HGO) or reciprocating gait orthosis (RGO).

Thus, the walking assist device 10 is designed as an active motion device, namely, the walking assist device 10 may partially or fully provides the power to drive the user's lower limbs.

In the embodiment, each leg assembly 200 further includes a hip joint motion combination 290 and a knee joint motion combination 295, and the hip joint motion combination 290 and the knee joint motion combination 295 are disposed on the upper stand 212 and the lower stand 214, respectively, but the positions of the hip joint motion combination 290 and the knee joint motion combination 295 are not limited thereto. The waist assembly 100 includes a battery 150 electrically connected to the hip joint motion combination 290 and the knee joint motion combination 295, and the hip joint motion combination 290 and the knee joint motion combination 295 respectively include a motor and a decelerating mechanism, so as to drive the motion of the hip joint 240 and the knee joint 250. In addition, the walking assist device 10 may also be collocated with other assisting implements like crutches and so on to enhance the stability during walking.

Figure 8:
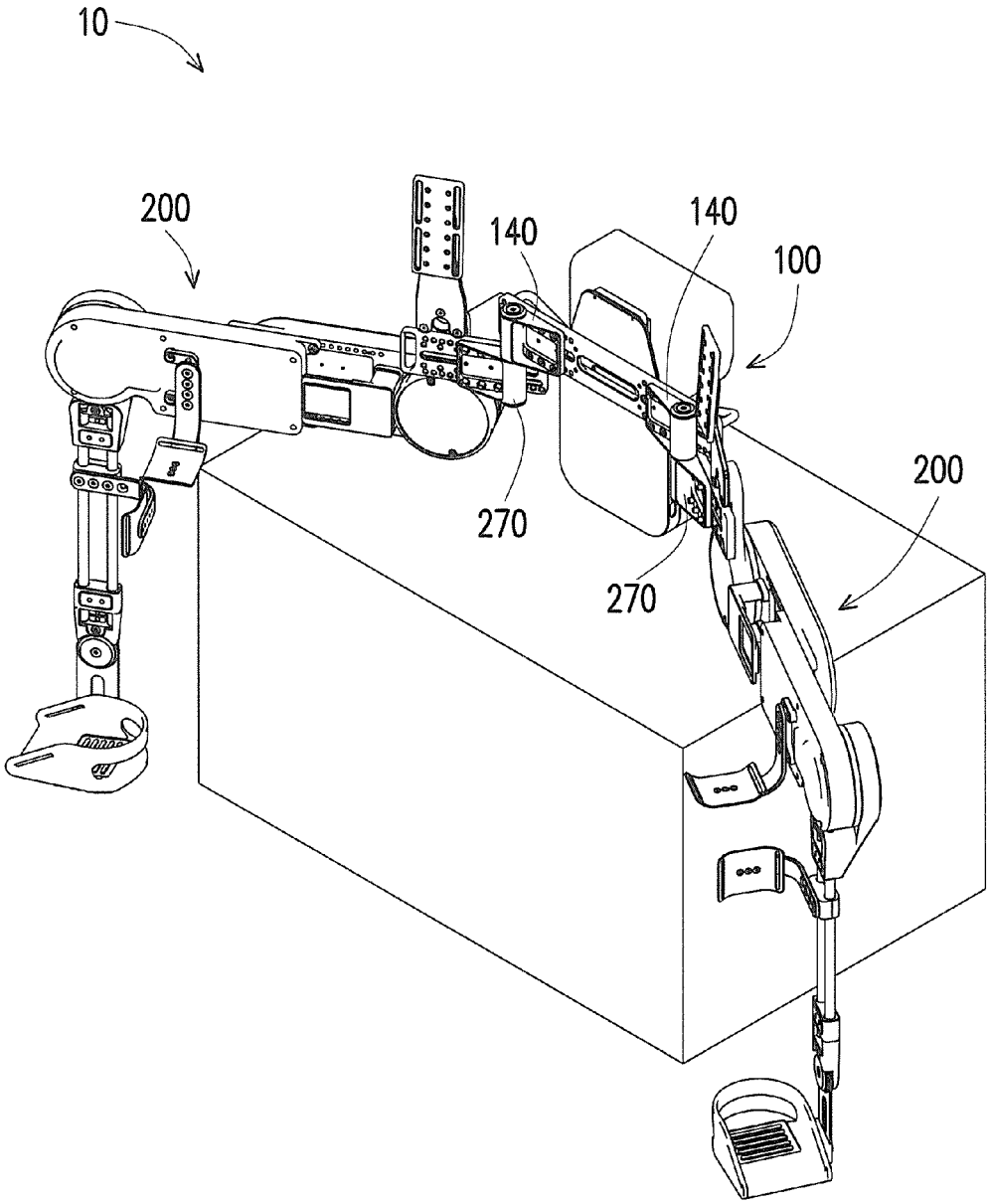
FIG. 8 is a schematic view showing the two leg assemblies of the walking assist device of FIG. 1 are spread.
Figure 9:
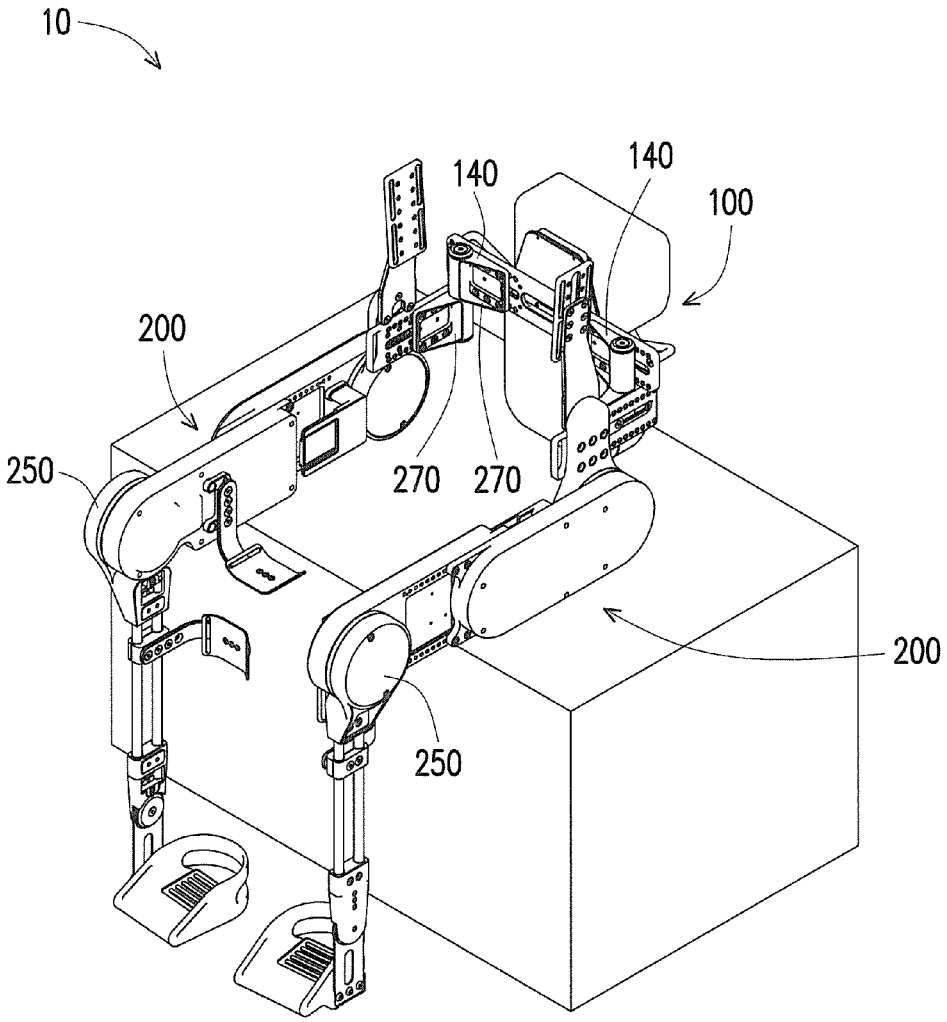
FIG. 9 is a schematic view showing the two leg assemblies of the walking assist device of FIG. 1 are closing up.

In the embodiment, since the first movable member 140 and the second movable member 270 are pivoted by the pivoting shaft 300, the second movable member 270 may rotate relatively to the first movable member 140, such that the angle between the two leg assemblies 200 is changeable. FIG. 8 is a schematic view showing the two leg assemblies of the walking assist device of FIG. 1 are spread. FIG. 9 is a schematic view showing the two leg assemblies of the walking assist device of FIG. 1 are closing up. Referring to FIG. 8 and FIG. 9, when the user is going to wear the walking assist device 10, by rotating the two second movable members 270, the two leg assemblies 200 are spread relative to the waist assembly 100 (as shown in FIG. 8), and the user may conveniently put on the walking assist device. After the user put on the walking assist device 10, the two leg assemblies 200 are closing up (as shown in FIG. 9) to start the ready state.

It should be mentioned that, in order to prevent the two leg assemblies 200 from being too closing up (i.e., the two knee joints 250 are attached or even crisscross) and causing the user unable to step straight forward or even tripped, in the embodiment, the angle between the first movable member 140 and the second movable member 270 is limited, limiting that when the two leg assemblies 200 are closing up, for example, merely enable to return to the parallel situation as shown in FIG. 9, and the two knee joints 250 may not further close up.

Figure 10:
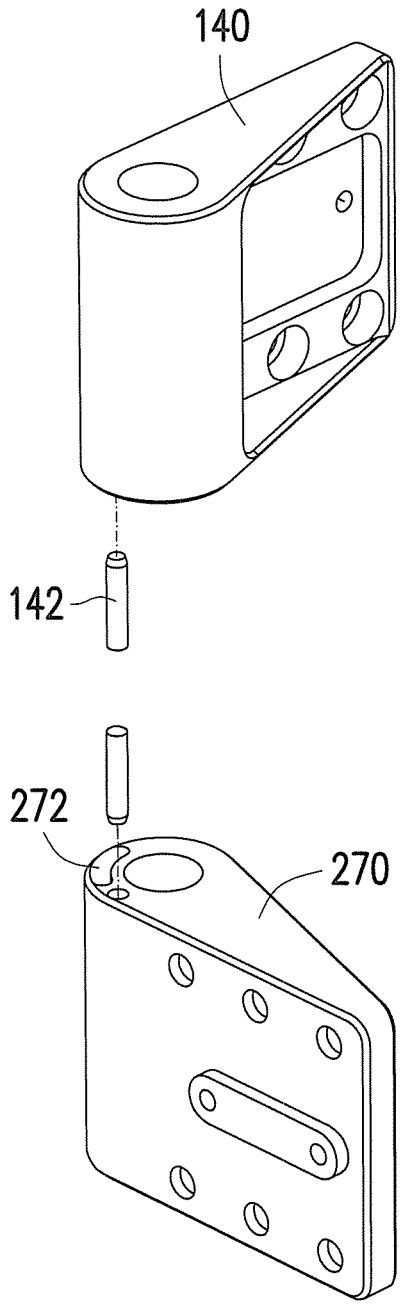
FIG. 10 is a schematic enlarged view of the first movable member and the second movable member of the walking assist device of FIG. 1.

FIG. 10 is a schematic enlarged view of the first movable member and the second movable member of the walking assist device of FIG. 1. Referring to FIG. 10, in the embodiment, each first movable member 140 includes at least one first limiting portion 142, each second movable member 270 includes at least one second limiting portion 272, and the first limiting portion 142 and the second limiting portion 272 are used for limiting the rotating angle between the first movable member 140 and the second movable member 270. In detailed, referring to FIG. 10, the first limiting portion 142 is a pillar embedded in the first movable member 140, the second limiting portion 272 is a trench located above the second movable member 270, the first limiting portion 142 may be slidably disposed at the second limiting portion 272 and limited by the range of the second limiting portion 272, and the rotating angle between the first movable member 140 and the second movable member 270 is limited. In the embodiment, there is also another pillar embedded in the second movable member 270 and slidably disposed at the trench (not shown) located below the first movable member 140, the collocation between the two pillars and the two trenches may provide stable and limited rotation between the first movable member 140 and the second movable member 270.

In another embodiment not shown in the drawings, the first movable member 140 and the second movable member 270 may respectively include a limiting portion, the pivoting shaft 300 may include two limiting structures respectively corresponding to the limiting portion of the first movable member 140 and the limiting portion of the second movable member 270, for limiting the rotating angle between the first movable member 140 and the second movable member 270. Similarly, one of the limiting portion and the limiting structure may be a trench, and the other may be a protruding pillar inserted into the trench. Certainly, the method of limiting the rotating angle of the first movable member 140 and the second movable member 270 is not limited thereto.

In light of the foregoing, the ankle joint of the walking assist device of the disclosure is directly or indirectly pivoted to the shank stand via the first end of the flexible plate, the second end of the flexible plate is connected to the sole, the flexible plate may generate left and right bending deformation due to the shift of center of mass when the user walks, such that when the user walks the soles may completely contact with the floor and when the user's body inclines the soles may not be apart from the floor, and stability and safety during walking may be effectively enhanced. In addition, the elastic member on the ankle joint presses the first end of the flexible plate, so as to provide a larger friction force between the shank stand and the ankle joint, when the user raises his leg, dangerous situation that the sole hangs down by gravity to cause the front part of foot contact with the floor may be prevented, and stability during walking may further be increased.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A walking assist device, comprising:

a waist assembly; and at least one leg assembly, connected to the waist assembly, the leg assembly comprising:

a thigh stand;

a shank stand;

a sole;

a hip joint, pivoted to the thigh stand;

a knee joint, pivoted to the thigh stand and connected to the shank stand; and an ankle joint, comprising at least a flexible plate and an elastic member, wherein the flexible plate comprises a first end and a second end opposite to the first end, the first end is directly or indirectly pivoted to the shank stand, the second end is connected to the sole, and the elastic member presses the first end of the flexible plate;

wherein the waist assembly comprises at least one first movable member, the leg assembly comprises at least one second movable member, the first movable member and the second movable member are individually pivoted by a pivoting shaft, the first movable member comprises a first limiting portion, the second movable member comprises a second limiting portion, and the first limiting portion and the second limiting portion are used for limiting a rotating angle between the first movable member and the second movable member.

2. The walking assist device as claimed in claim 1, wherein the waist assembly comprises a left-right adjusting member, and the leg assembly is adjustably connected to the left-right adjusting member along a left-right direction axis.

3. The walking assist device as claimed in claim 1, wherein the leg assembly comprises a front-rear adjusting member, and the thigh stand is adjustably connected to the front-rear adjusting member along a front-rear direction axis.

4. The walking assist device as claimed in claim 1, wherein the waist assembly comprises a hip reaction plate used for propping against a user's hips.

5. The walking assist device as claimed in claim 1, wherein the thigh stand comprises an upper stand and a lower stand, and the lower stand is adjustably fixed to the upper stand.

6. The walking assist device as claimed in claim 5, wherein the leg assembly comprises a hip joint motion assembly and a knee joint motion assembly, and the hip joint motion assembly and the knee joint motion assembly are disposed on the upper stand and the lower stand, respectively.

7. The walking assist device as claimed in claim 1, wherein the shank stand is adjustably inserted into the knee joint.

8. The walking assist device as claimed in claim 1, wherein the waist assembly comprises at least one chest side plate, connected to the leg assembly and extending in a direction away from the thigh stand.

9. The walking assist device as claimed in claim 1, wherein the ankle joint further comprises two spacers sandwiching the first end of the flexible plate.

10. The walking assist device as claimed in claim 1, wherein the sole is a half type sole.

* * * * *